United States Patent [19]

Welp et al.

[11] 4,196,999

[45] Apr. 8, 1980

[54] DEVELOPING APPARATUS FOR DUPLICATING OF FILM PATTERNS ON DIAZO-MATERIAL BY MEANS OF AMMONIA GAS

[75] Inventors: Ulrich Welp, Bad Nauheim; Jürgen Sahlmann, Woelfersheim, both of Fed. Rep. of Germany

[73] Assignee: Microbox Dr. Welp GmbH & Co., Bad Nauheim, Fed. Rep. of Germany

[21] Appl. No.: 26,008

[22] Filed: Apr. 2, 1979

Related U.S. Application Data

[63] Continuation-in-part of Ser. No. 830,819, Sep. 6, 1977.

[30] Foreign Application Priority Data

Apr. 13, 1978 [AT] Austria ..... 25957/78

[51] Int. Cl.[2] ..... G03D 7/00

[52] U.S. Cl. ..... 354/299; 354/300; 354/317; 354/324; 34/219

[58] Field of Search ..... 354/299, 300, 317, 324; 34/23, 26, 36, 37, 155, 219; 417/395

[56] References Cited

U.S. PATENT DOCUMENTS

| | | | |
|---|---|---|---|
| 1,904,551 | 4/1933 | Smith | 34/219 |
| 3,323,436 | 6/1967 | Hafer et al. | 354/300 |
| 3,748,995 | 7/1973 | Schröter et al. | 354/300 |
| 4,048,645 | 9/1977 | Reams | 354/300 |
| 4,121,236 | 10/1978 | Welp et al. | 354/317 |

*Primary Examiner*—L. T. Hix
*Assistant Examiner*—Alan Mathews
*Attorney, Agent, or Firm*—W. G. Fasse; D. F. Gould

[57] ABSTRACT

Film patterns are duplicated onto diazo-material in a developing apparatus which has a circulatory flow circuit with a pump for the developer ammonia gas to circulate the latter in sequential steps between a developing chamber and an ammonia gas supply container. Magnetic control valves open and close other valves in the closed circuit and in access circuits to make sure that the developing takes place in said sequence. The access circuits include an auxiliary gas container, a further pump and a vacuum container as well as further controlling and controlled valves for the sequence control.

13 Claims, 8 Drawing Figures

DEVELOPING APPARATUS FOR DUPLICATING OF FILM PATTERNS ON DIAZO-MATERIAL BY MEANS OF AMMONIA GAS

CROSS REFERENCE TO RELATED APPLICATIONS

The present application is a continuation-in-part of our copending application U.S. Ser. Number 830,819; filed on Sept. 6, 1977.

BACKGROUND OF THE INVENTION

The invention relates to an apparatus for duplicating of film patterns on diazo-material by means of ammonia gas.

Our copending application Ser. No. 830,819 describes a developing apparatus of this type in its basic structure. In such a developing apparatus copies of duplicates are made from a suitable original such as a silver film or a diazo-film onto a further diazo-film by circulating the ammonia gas in a closed, evacuated circuit including the developing chamber. The ammonia gas is compressed in the developing chamber and expanded again as it is returned to a heatable supply chamber. The apparatus includes a closed circuit arrangement between the supply chamber and the developing chamber as well as an evacuating device connected to the developing chamber.

In the parent case and in the references cited in the parent case there is room for improvement, particularly with regard to the construction and control of the membrane pumps and of the structural components essential for the ammonia circulatory system. It is also required for an efficient developing operation, that a specific sequence of steps be rigidly enforced with unfailing repeatability.

OBJECTS OF THE INVENTION

In view of the above, it is the aim of the invention to achieve the following objects, singly or in combination:

to provide an improved control system for a diazo-film developing apparatus;

to assure a repeatable sequence of steps in the developing of diazo-film;

to construct a compact developing apparatus including membrane pump means, preferably a dual membrane pump;

to provide a compact membrane valve, especially for the present developing apparatus; and to provide a control circuit with magnetically or electrically responsive valves which control membrane valves and/or membrane pumps in a predetermined sequence.

SUMMARY OF THE INVENTION

According to the invention there is provided a system for developing diazo-material wherein a membrane pump, an ammonia water container and a developing chamber with the respective conduit means form a first flow circuit controllable by three valves, preferably membrane valves, inserted between the pump and the ammonia water container, between the pump and the developing chamber, and between the developing chamber and the ammonia water container. The membrane pump is connected through a controlled valve to a gas container. A second flow circuit includes a further pump, also preferably a membrane pump, a vacuum container and the developing chamber as well as controlled valves in the conduits connecting the vacuum container, the developing chamber and the further pump.

The valves are controlled by magnetically or electrically responsive valves. The controlled valves are preferably also membrane valves. The two membrane pumps, the gas container and the developing chamber form a compact structural unit.

BRIEF FIGURE DESCRIPTION

In order that the invention may be clearly understood, it will now be described, by way of example, with reference to the accompanying drawings, wherein.

Figure 3:
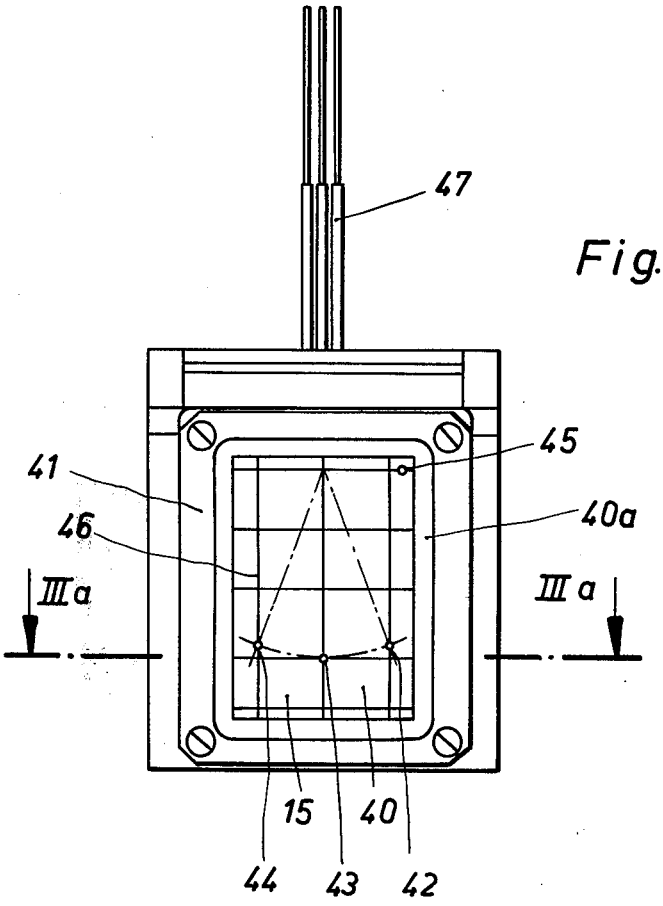
Figure 3A:
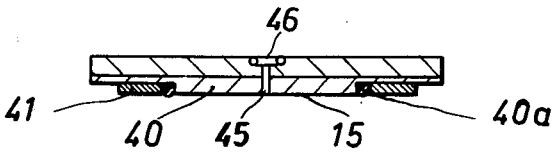
Figure 4:
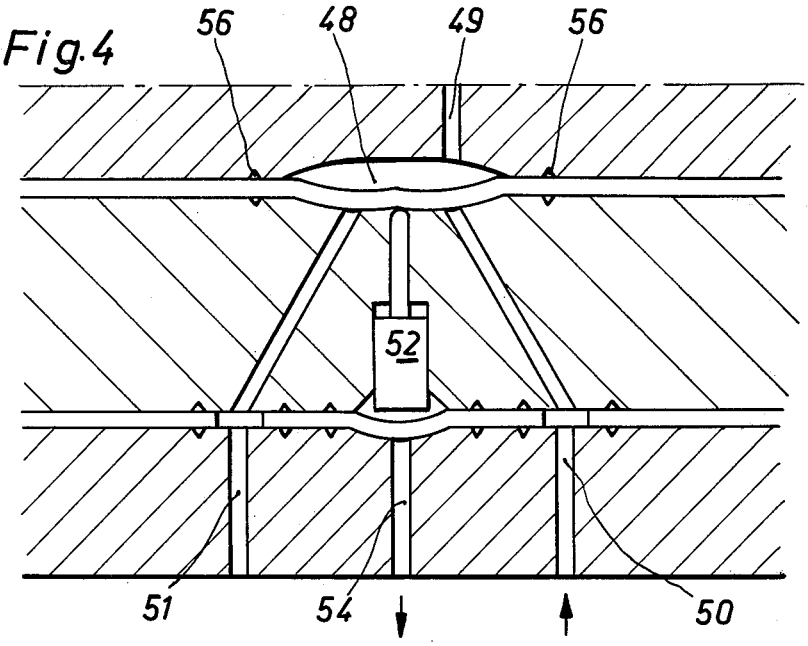
Figure 5:
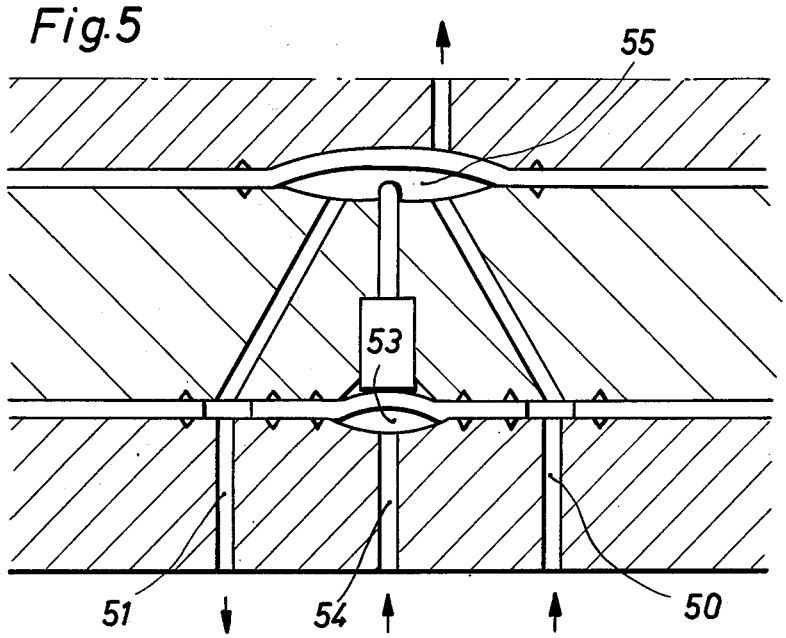
Figure 6:
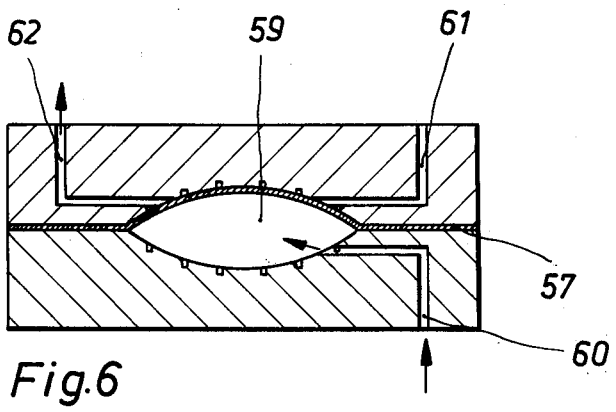
Figure 7:
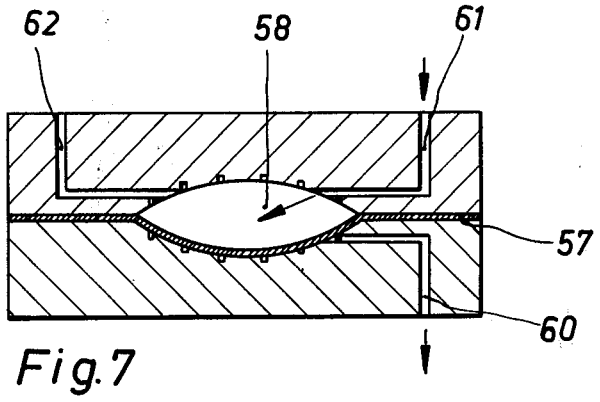

FIGS. 3 and 3*a* show a preferred embodiment of the developing chamber;

FIGS. 4 and 5 show an auxiliary arrangement for a membrane valve on an enlarged scale; and FIGS. 6 and 7 show an advantageous embodiment of the membrane pump.

Figure 1:
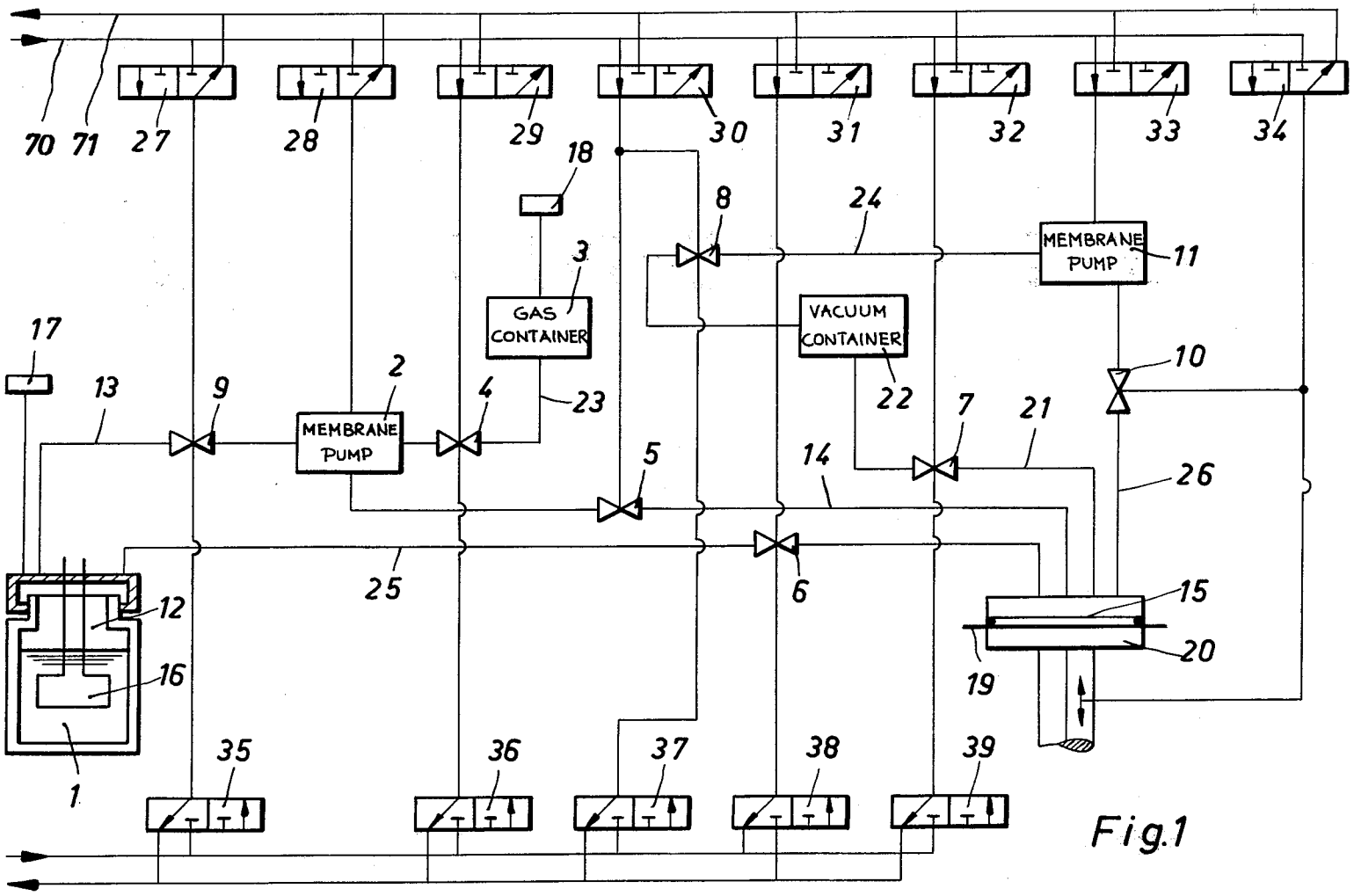
FIG. 1 shows a schematic control circuit according to the invention including magnetic control valves and flow conduits with controlled valves.

DETAILED DESCRIPTION OF PREFERRED EXAMPLE EMBODIMENTS ILLUSTRATING THE BEST MODE OF THE PRESENT INVENTION:

The apparatus according to the invention is schematically shown in FIG. 1. The apparatus is used to develop diazomaterial.

Initially it is necessary to evacuate the gas-air volume or the air volume present in the ammonia water container 1, in the membrane pump 2, and in the gas container 3. Initially the valves 4, 5, 6, 7, and 8 are connected to a source of pressure (not shown but connected to line 70) and closed. The valves 9 and 10 are connected to reduced pressure or suction on line 71 and are opened. The membrane pump 11 is connected to pressure on line 70 and the membrane pump 2 is connected to reduced pressure or suction on line 71.

First it is necessary to suck the gas-air mixture 12 out of the container 1 which is filled with ammonia water, whereby the valves 4, 5, and 6 are closed. A certain proportion of the gas-air mixture 12 is sucked into the space of the membrane pump 2 through the conduit 13 because the valve 9 is open and the membrane pump 2 is connected to reduced pressure on line 71. Thereafter the valve 9 is closed, the valve 5 is opened, and the membrane pump 2 is connected to pressure. Thus, it is possible to discharge the gas-air mixture 12 present in the membrane pump 2 to the outside through the conduit 14 and through the opened developing chamber 15. By closing the valve 5, opening the valve 9 and again connecting the membrane pump 2 to reduced pressure, the described sequence repeats itself until a certain reduced pressure is present in the ammonia water container 1. The valve 5 is closed when this desired reduced pressure is reached, the valve 9 remains closed and the membrane pump 2 remains under pressure.

In order to obtain the pressure of, for example, 5 to 7 bar which is desired for the development of the diazo-material, it may be suitable to provide a gas container 3 in which a gas is present under a small pressure of, for example, 0.5 bar. This container is evacuated prior to its filling with the gas as follows.

The valves 4 and 5 are closed. As a result of the preceding sequence the valve 9 is closed and the membrane pump 2 is under pressure. The membrane pump 2 is then connected to reduced pressure and the valve 4 is opened, as a result, a portion of the air is sucked out of the gas container 3 into the space of the membrane pump 2. The valve 4 is being closed, the membrane pump 2 is again connected to pressure and the valve 5 is being opened. Thus, the air sucked out of the gas container 3 by the membrane pump 2 is discharged through the open developing chamber 15. The valve 5 is subsequently closed again. By opening the valve 4 and applying reduced pressure to the membrane pump 2 the described sequence of steps is repeated until the gas container 3 exhibits a specific reduced pressure. The valve 5 is then closed and the membrane pump 2 remains under pressure. Thus, the evacuation is completed.

Now the gas container 3 is filled with ammonia gas as follows.

The valves 5, 6, and 4 are closed. A portion of the ammonia gas is sucked out of the ammonia water container 1 into the membrane pump 2 by applying reduced pressure to the membrane pump 2. The $NH_3$ gas is released more quickly, if a heating means 16 is arranged in the ammonia water container 1. The heating means 16 are controlled according to the invention by a reduced pressure switch 17. The valve 9 is being closed. The valve 4 is being opened and pressure is applied to the membrane pump 2. Thus, the ammonia gas is supplied into the gas container 3. The valve 4 is being closed. The membrane pump 2 is connected to reduced pressure and the valve 9 is being opened. Thereafter, ammonia gas $NH_3$ is again sucked out of the ammonia water container 1 into the membrane pump 2. By closing the valve 9, opening the valve 4 and connecting the membrane pump 2 to pressure the sequence is repeated until a specific pressure is present in the gas container 3. This pressure is controlled by the pressure switch 18.

After the completion of the above preparations, the developing sequence takes place as follows.

The diazo-material 19 is placed into the developing chamber 15. The developing chamber 15 is closed by means of the pressure plate 20 while simultaneously closing the valve 10. The valve 7 is opened whereby air present in the developing chamber 15 is sucked off through the conduit 21 into the vacuum container 22. The valve 4 is opened and the membrane pump 2 is filled with $NH_3$ from the gas container 3 through the conduit 23. By closing the valve 4 the $NH_3$ gas present in the membrane pump 2 is supplied through the conduit 14 into the developing chamber 15 and compressed. The valve 8 is opened simultaneously with the valve 5 and the membrane pump 11 is connected to reduced pressure, whereby air previously sucked out of the developing chamber 15 into the vacuum container 22 is sucked into the membrane pump 11 through the conduit 24. Upon completion of the developing time and opening of the valve 4 the compressed gas may expand into the gas container 3 through the conduits 14, 23 and the membrane pump 2. By closing the valves 8, 5, and 4 and opening the valve 6 the remaining gas is sucked out of the developing chamber 15 through the conduit 25 and into the ammonia water container 1, which is under reduced pressure. Thereafter the valve 6 is closed. The pressure plate 20 of the developing chamber 15 is pulled back. Simultaneously the valve 10 is opened and the membrane pump 11 is connected to pressure. Thus, the air present in the membrane pump 11 is supplied through the conduit 26 to the developing chamber 15 whereby it may solve the diazo-material 19 present in the developing chamber 15. After removal of the developed diazo material, new, non-developed diazo-material is placed into the developing chamber and a new developing sequence may begin.

The magnetic valve 27 controls the valve 9.

The magnetic valve 28 controls the membrane pump 2.

The magnetic valve 29 controls the valve 4.

The magnetic valve 30 controls the valve 5.

The magnetic valve 31 controls the valve 6.

The magnetic valve 32 controls the valves 7.

The magnetic valve 33 controls the membrane pump 11.

The magnetic valve 34 controls the valve 10 and the pressure plate 20.

The magnetic valve 35 controls the valve 9.

The magnetic valve 36 controls the valve 4.

The magnetic valve 37 controls the valve 8.

The magnetic valve 38 controls the valve 6.

The magnetic valve 39 controls the valve 7.

Figure 2:
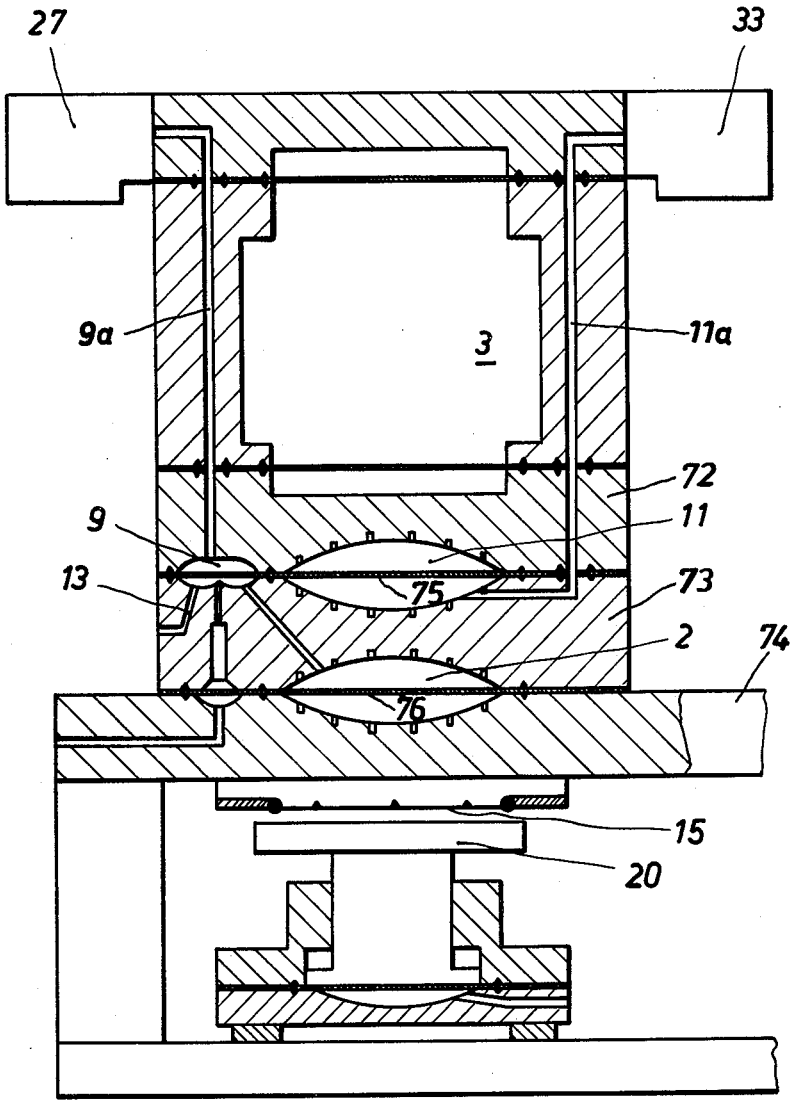
FIG. 2 shows a vertical section through a structural unit which integrates two membrane pumps with the developing chamber and with the gas container in a compact structure.

FIG. 2 shows as an example a developing apparatus according to the invention.

In this apparatus the gas container 3 and the two membrane pumps 11 and 2 as well as the developing chamber 15 are integrated into a structural unit. The gas container 3 is suitably cylindrical. The magnetic valves 27 and 33 are arranged at its upper edge for controlling the valve 9 through the conduit **9*a* by the valve 27 and for controlling the membrane pump 11 through the conduit 11*a* by the valve 33. The two membrane pumps 11 and 2 are located coaxially below the gas container 3. The membrane pumps are formed by respectively profiled or shaped circular plates 72, 73 and a portion 74 of the housing of the developing chamber 15. The membrane disks 75, 76 are clamped between the plates 72, 73 and the plate 73 and housing portion 74** respectively.

The developing chamber 15 is arranged on the underside of the membrane pump 2. The pressure plate 20 is arranged below the developing chamber 15.

FIG. 3 shows an especially advantageous embodiment of the developing chamber 15. An O-ring **40*a* secured to the underside of the sheet metal cover 40 of the developing chamber 15 determines the height of the developing chamber when the latter is closed by the pressure plate 20. A support sheet metal 41 prevents lateral excursions of the O-ring 40*a*. Bores 42 to 45 are arranged in the sheet metal cover 40** for the supply and discharge of gas and air.

The developing chamber 15 is closed by pressure plate 20 after placing diazo-material into the developing chamber. The air present in the chamber is sucked out through the bore 42 in the cover plate 40. $NH_3$ gas is supplied and returned through the bore 43. Remaining gas is sucked out of the chambers through the bore 44 and the air initially sucked out is supplied through the bore 45 for solving the diazo-material 19. The bores 42, 43, 44, and 45 are interconnected with one another by the grooves 46 in the manner shown in order to accomplish a complete sucking-off of air and gas. Without these grooves 46 the diazo-material 19 would be pulled against the bores during sucking and a complete emptying of the developing chamber 15 would not be possible.

If necessary, the developing chamber 15 may be heated to a determined temperature through the cable 47 and a heating means arranged inside the developing chamber 15.

FIGS. 4 and 5 show on an enlarged scale an especially advantageous embodiment of the valves described with reference to FIG. 1. In FIG. 4 the control chamber 48 is connected to pressure through the conduit 49. Thus, the passage of the conduit 50 to the conduit 51 is closed. The push rod 52 is in its rest position due to the application of reduced pressure in the control chamber 53 through the conduit 54.

In FIG. 5 the control chamber 48 is connected to reduced pressure through the conduit 49. Thus, a passage is provided between the conduits 50 and 51 through the valve chamber 55. The push rod 52 is in its uppermost position due to the application of pressure in the control chamber 53 through the conduit 54. Due to the rising of the push rod 52 a certain opening of the valve is assured.

Sealing grooves 56 are arranged around the valves and around the conduits in order to increase the operating reliability.

FIGS. 6 and 7 show an especially advantageous embodiment of the membrane pumps 2 and 11 described with reference to FIG. 1. As shown in FIG. 6 the membrane 57 rests against the upper boundary of the gas chamber 58 (FIG. 7). The control chamber 59 (FIG. 6) is maintained under pressure through the control conduit 60. The suction conduit 61 is closed and the pressure conduit 62 is opened.

According to FIG. 7 the control chamber 59 (FIG. 6) is connected to reduced pressure through the control conduits 60. The suction conduit 61 is open and the pressure conduit 62 is closed. During this state of conditions the ammonia gas is sucked out of the ammonia water container 1. The gas may now be further conveyed or compressed by switching into the state or condition illustrated in FIG. 6.

Although the invention has been described with reference to specific example embodiments it will be appreciated, that it is intended to cover all modifications and equivalents within the scope of the appended claims.

What is claimed is:

1. A developing apparatus for duplicating film patterns on diazo-material by means of ammonia gas, comprising developing chamber means (15), evacuable ammonia water container means (1), first pump means (2), first conduit means (13, 14) and respective valve means (5, 9) operatively connecting said ammonia water container means (1) to said developing chamber means (15) through said first pump means (2) to form a supply branch, second conduit means (25) and respective valve means (5) operatively connecting said developing chamber means (15) to said ammonia water container means (1) to form a return branch, auxiliary gas container means (3), third conduit means (23) and respective valve means (4) operatively connecting said auxiliary gas container means (3) to said first pump means (2), vacuum container means (22), second pump means (11), fourth conduit means (21) and respective valve means (7) operatively connecting said vacuum container means (22) to said developing chamber means (15), fifth conduit means (24) and respective valve means (8) operatively connecting said vacuum container means (22) to said second pump means (11), and sixth conduit means (26) including respective valve means (10) operatively connecting said second pump means (11) to said developing chamber means (15).

2. The apparatus of claim 1, wherein said first and second pump means (2, 11) are membrane pump means.

3. The apparatus of claim 1, further comprising heater means (16) operatively associated with said ammonia water container means (1).

4. The apparatus of claim 1, wherein said valve means comprise controlling valve members and controlled valve members, said controlled valve members (4, 5, 6, 7, 8, 9, 10) comprising membrane valves.

5. The apparatus of claim 4, wherein said controlling valve members are magnetic valves.

6. The apparatus of claim 4, wherein certain of said controlled membrane valves comprise membrane means, sealing surface means, and means operatively arranged for moving the respective membrane means away from the respective sealing surface means, said membrane moving means being provided for those controlled membrane valve means in which reduced pressure is effective on the closing side of the membrane when the valve is in its closing position.

7. The apparatus of claim 6, wherein said membrane moving means comprise a pressure operated push rod.

8. The apparatus of claim 7, wherein said push rod is operated by hydraulic pressure.

9. The apparatus of claim 1, further comprising magnetic control valve means for said first and second pump means.

10. The apparatus of claim 1, wherein said developing chamber means (15) comprise cover means (40) having a bottom side, and O-ring means secured to said bottom side.

11. The apparatus of claim 10, further comprising support means for laterally enclosing said O-ring means.

12. The apparatus of claim 10, wherein said cover means comprise apertures for the supply and discharge of air and gas.

13. The apparatus of claim 12, further comprising groove means (46) operatively interconnecting said apertures when diazo-material is located in said developing chamber means.

* * * * *